US006796950B1

(12) United States Patent
Müller

(10) Patent No.: US 6,796,950 B1
(45) Date of Patent: Sep. 28, 2004

(54) MASSAGING APPARATUS HAVING A SUCTION CHAMBER AND TWO ROLLERS

(75) Inventor: Ingo Müller, Klagenfurt (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 358 days.

(21) Appl. No.: 09/420,306

(22) Filed: Oct. 18, 1999

(30) Foreign Application Priority Data

Oct. 16, 1998 (EP) ..... 98890302

(51) Int. Cl.[7] ..... A61H 15/00
(52) U.S. Cl. ..... 601/112
(58) Field of Search ..... 601/112, 122, 601/125, 123, 126, 133, 134, 135

(56) References Cited

U.S. PATENT DOCUMENTS 448,883 A * 3/1891 Kahn ..... 601/122
6,017,320 A * 1/2000 Bleeker et al. ..... 601/125

FOREIGN PATENT DOCUMENTS

GB 000002558 A * of 1890 ..... 601/125
WO 98/02124 1/1998 ..... A61H/15/00

* cited by examiner

*Primary Examiner*—Nicholas D. Lucchesi
(74) *Attorney, Agent, or Firm*—Ernestine C. Bartlett

(57) ABSTRACT

In a massaging apparatus (1) comprising a suction chamber (12) bounded by chamber walls (13, 14, 15, 16) and a pump (19) for the generation of a partial vacuum inside the suction chamber (12) and thus forming a skin fold (20) which is drawn into the suction space inside the suction chamber (12), as well as two rollers (21, 22) to be placed onto a body area (3), the two rollers (21, 22) can be driven by a motor (27) via a drive transmission (28), and the roller (21) which is disposed at the front, as viewed in the operating direction (4), is arranged inside the suction chamber (12), and the roller (22) which is disposed at the rear, as viewed in the operating direction (4), is arranged outside the suction chamber (12), the circumferential surface (25) of the roller (21) which is disposed at the front, as viewed in the operating direction (4), advantageously consisting of a material having a friction value higher than that of the material of the roller which is disposed at the rear, as viewed in the operating direction (4).

3 Claims, 2 Drawing Sheets

MASSAGING APPARATUS HAVING A SUCTION CHAMBER AND TWO ROLLERS

BACKGROUND OF THE INVENTION

The invention relates to a massaging apparatus for massaging body areas of a person, which massaging apparatus can be placed onto the skin of a body area of a person during a massaging session and is preferably movable over the skin in a given operating direction, and which comprises a suction chamber which encloses a suction space and which comprises two chamber walls which extend substantially transversely to the operating direction and two chamber walls which extend substantially parallel to the operating direction and are connected to the two chamber walls which extend transversely to the operating direction, and which is open in its area which faces the skin of a body area when the massaging apparatus is disposed on the skin, and which comprises a pump which communicates with the suction chamber via an air-transfer duct so as to allow the passage of air and by means of which a partial vacuum can be generated inside the suction chamber when the massaging apparatus is disposed on the skin of a body area, in order to form a skin fold which is drawn into the suction chamber, and which comprises two rollers which can be placed onto the skin of a body area with their circumferential surfaces, and which are each rotatable about a roller axis which extends transversely to the operating direction and which can be driven in the same direction of rotation by means of a motor via a drive transmission, the speed vectors of the circumferential areas of the circumferential surfaces of the two rollers, which face the skin of a body area when the massaging apparatus is disposed on the skin are oriented oppositely to the operating direction, of which rollers the roller which is disposed at the front, as viewed in the operating direction, is arranged inside the suction chamber, and the roller which is disposed at the rear, as viewed in the operating direction, is arranged outside the suction chamber.

Such a massaging apparatus of the type defined in the opening paragraph is known, for example, from the patent document WO 98/02124 A1, reference being made in particular to FIG. 9 and the corresponding part of the description of the Figures of said document. In relation to the massaging apparatus disclosed in FIG. 9 of the patent document WO 98/02124 A1 no reference is made to the construction of the two rollers and the circumferential surfaces of the two rollers. However, the patent document WO 98/02124 A1 also discloses a further massaging apparatus in which the two rollers are disposed outside the suction chamber. With regard to this massaging apparatus reference may be made, for example, to FIG. 3 of the patent document WO 98/02124 A1 and the corresponding part of the description of the Figures, in which description it is remarked that the forward roller, as viewed in the operating direction, is wholly made of a comparatively hard material and that the rearward roller, as viewed in the operating direction, has an inner part made of a comparatively hard material but has a circumferential portion of a comparatively soft material and the circumferential surface of this roller consequently consists of a comparatively soft material. This construction has proved to be advantageous and satisfactory for a massaging apparatus in which the two rollers are disposed outside the suction chamber. However, tests conducted by the Applicant have proved that such a roller construction, as used in the massaging apparatus disclosed in FIG. 3 of the patent document WO 98/02124 A1, is not particularly favorable and advantageous in a massaging apparatus as shown in FIG. 9 of said patent document, in which the forward roller, as viewed in the operating direction, is disposed inside the suction chamber and the rearward roller, as viewed in the operating direction, is disposed outside the suction chamber.

SUMMARY OF THE INVENTION

It is an object of the invention to provide a satisfactory solution for the roller construction in a massaging apparatus of the type defined in the opening paragraph, in which the forward roller, as viewed in the operating direction, is disposed inside the suction chamber and in which the rearward roller, as viewed in the operating direction, is disposed outside the suction chamber, and to provide an improved massaging apparatus as compared with the massaging apparatuses in accordance with the patent document WO 98/02124 A1. To achieve this object, according to the invention, a massaging apparatus of the type defined in the opening paragraph is characterized in that the circumferential surface of the roller which is disposed at the front, as viewed in the operating direction, consists of a material having a friction value higher than that of the material of the roller which is disposed at the rear, as viewed in the operating direction.

By taking the steps in accordance with the invention it can be achieved in a very simple manner, namely by an appropriate choice of the combination of materials for the circumferential surfaces of the two rollers, that a proper and satisfactory movement of the massaging apparatus over the skin of a body area of a person is achieved and that, in addition, a satisfactory and proper formation of a skin fold and hence a good massaging action is obtained, which is achieved mainly because the movement of the massaging apparatus over the skin of a body area is effectively enhanced by the forward roller, as viewed in the operating direction, having a circumferential surface of a comparatively soft material and because the formation of a skin fold, basically by virtue of the suction effect in the suction space, is enhanced particularly by the forward roller, as viewed in the operating direction, having a circumferential surface of a comparatively soft material.

In a massaging apparatus in accordance with the invention it has proved to be particularly advantageous if the material of the circumferential surface of the forward roller, as viewed in the operating direction, has a hardness between 40 Shore A and 95 shore A and the material of the circumferential surface of the rearward roller, as viewed in the operating direction, has a hardness in a in a range between 50 $N/mm^2$ and 180 $N/mm^2$. Tests have revealed that for the circumferential surface of the forward roller, as viewed in the operating direction, a material having a hardness of approximately 85 Shore A and for the circumferential surface of the rearward roller, as viewed in the operating direction, a material having an indentation hardness in accordance with ISO 2039 of approximately 144 $N/mm^2$ have proved to be very favorable.

In a massaging apparatus in accordance with the invention it has further proved to be very advantageous if the circumferential surface of the forward roller which has a multitude of studs, and the circumferential surface of the rearward roller which has a smooth shape. The studs in the area of the circumferential surface of the forward roller very effectively enhance the movement of the massaging apparatus over the skin of a body area and, furthermore, the studs produce an additional massaging effect, as a result of which the effectiveness of the massaging apparatus is increased additionally.

The afore-mentioned as well as further aspects of the invention will be apparent from the embodiment described hereinafter by way of example and will be elucidated with reference to this example.

BRIEF DESCRIPTION OF THE DRAWINGS

The invention will now be described in more detail with reference to the drawings, which show an embodiment given by way of example, to which the invention is not limited.

DESCRIPTION OF THE PREFERRED EMBODIMENTS

Figure 1:
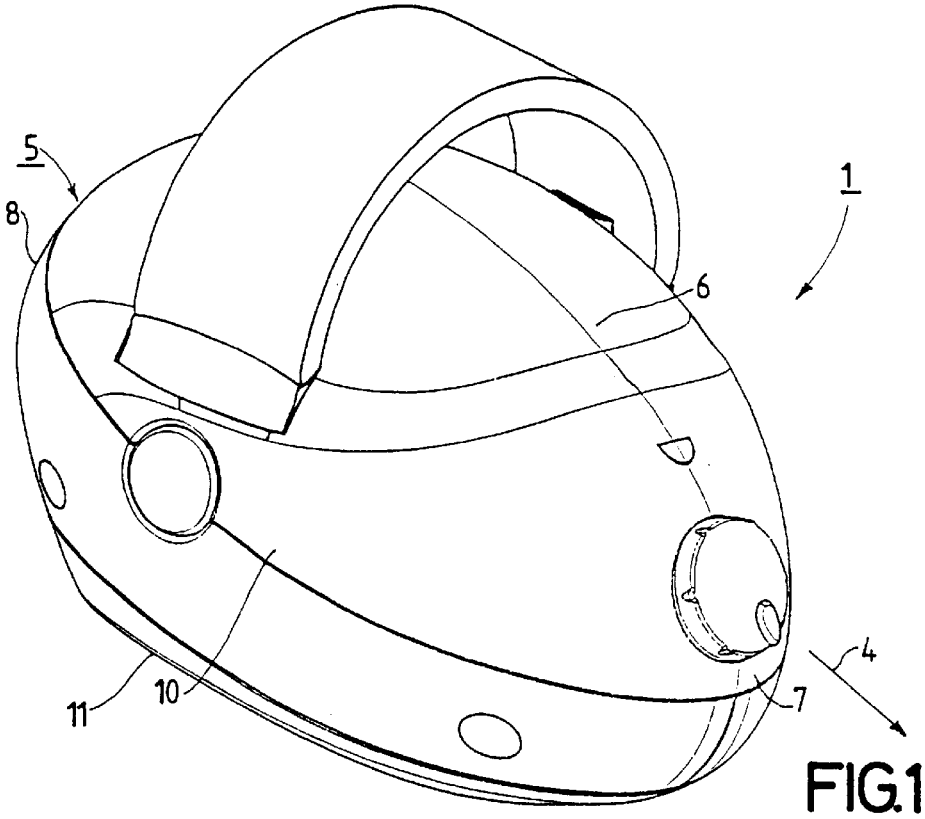
FIG. 1 is an oblique top view showing a massaging apparatus in accordance with an embodiment of the invention.
Figure 2:
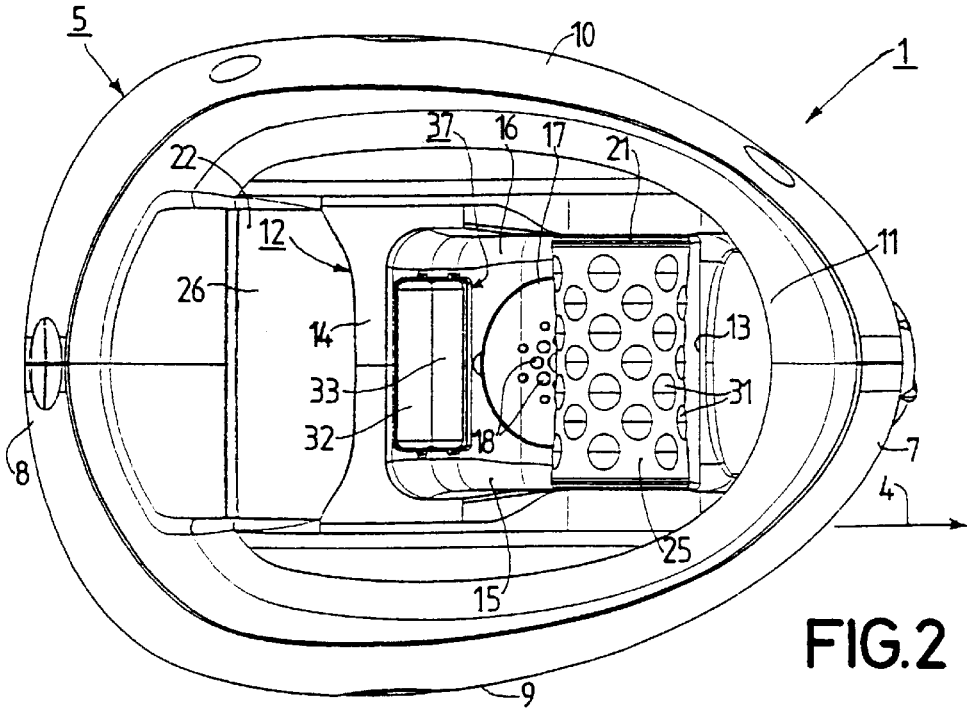
FIG. 2 shows the massaging apparatus of FIG. 1 in an underneath view.
Figure 3:
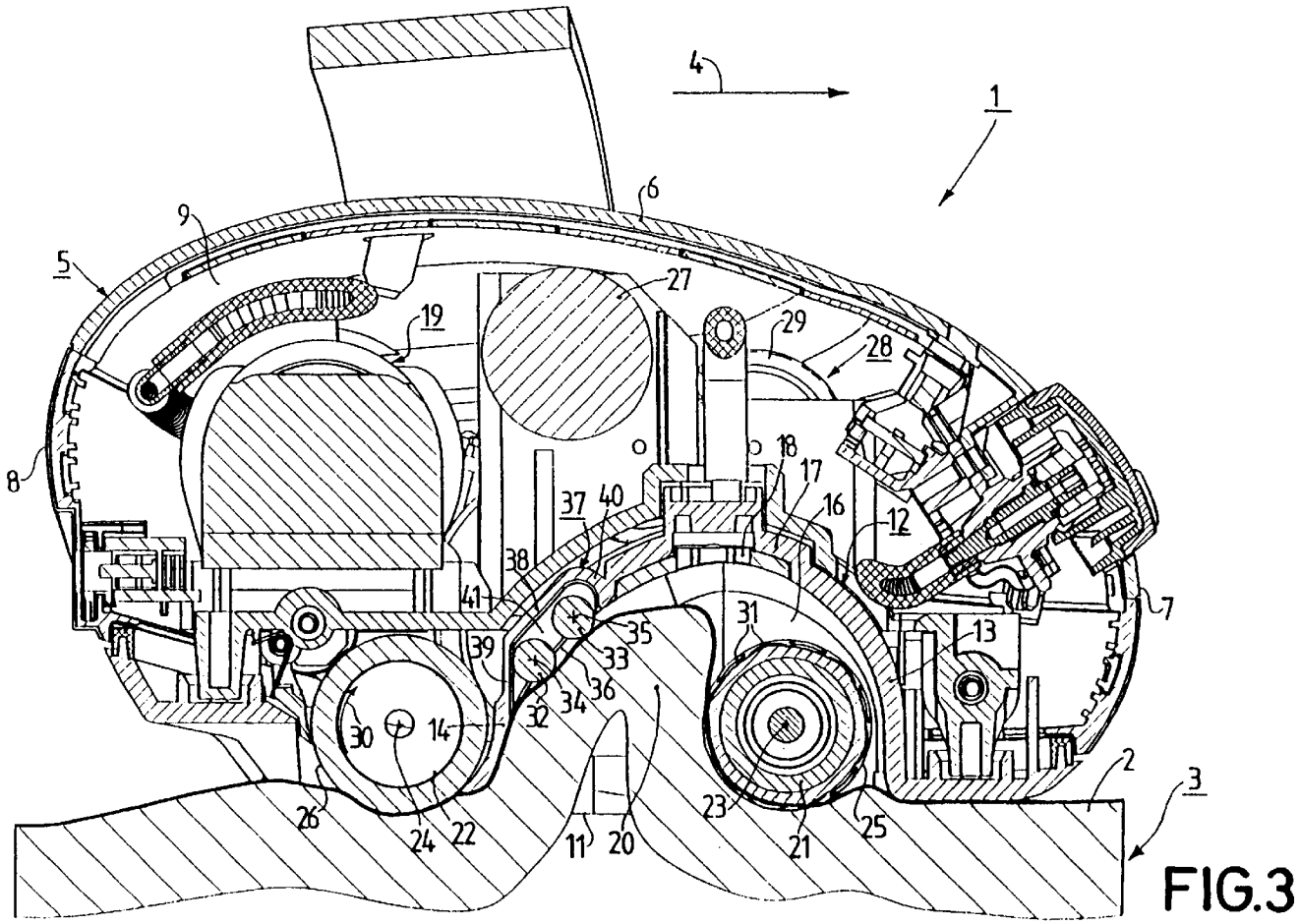
FIG. 3 shows the massaging apparatus of FIGS. 1 and 2 in a sectional view and also shows diagrammatically a skin fold formed during a massaging session.

FIGS. 1 to 3 show a massaging apparatus 1 intended for massaging body areas of a person. During a massaging session the massaging apparatus 1 can be placed onto a body area 3 of a person, as is shown diagrammatically in FIG. 3. During such a massaging session the massaging apparatus 1 is preferably movable over the skin 2 in a given operating direction, which operating direction is indicated by an arrow 4 in FIGS. 1 to 3. As regards the design and construction of the massaging apparatus 1 reference can be made to the patent document WO 98/02124 A1 already mentioned in the introductory part, which document is herewith incorporated by reference. In view of the detailed description of the known massaging apparatus disclosed in the patent document WO 98/02124 A1 the present Application only gives a detailed description of those design and construction features which differ from the known massaging apparatuses and which are relevant in the present context.

The massaging apparatus 1 comprises a housing 5 having an upper wall 6 and four side walls, namely a front side wall 7, a rear side wall 8, a left-hand side wall 9 and a right-hand side wall 10. The housing 5 has a bottom wall 11 at its side opposite to the upper wall 6.

The massaging apparatus 1 has a suction chamber 12 which encloses a suction space and which comprises two chamber walls 13 and 14 which extend substantially transversely to the operating direction 4 and which further comprises two chamber walls 15 and 16 which extend substantially parallel to the operating direction 4 and are connected to the two chamber walls 13 and 14 which extend transversely to the operating direction 4. The suction chamber 12 is open at the location which faces the skin 2 of a body area 3 when the massaging apparatus 1 is placed on the skin 2 with the bottom wall 11, i.e. at the location of the bottom wall 11. At the side opposite the open side the suction chamber 12 is closed by an upper chamber wall 17. The upper chamber wall 17 has passages 18 which are connected to a pump 19 via an air-transfer duct, which for reasons of simplicity is not shown in FIG. 3, so that the pump 19 communicates with the suction chamber 12 so as to allow the passage of air via the air-transfer duct, not shown.

When the massaging apparatus 1 has been placed with its bottom wall 11 onto the skin 2 of a body area 3 the pump 19 can generate a partial vacuum inside the suction chamber 12 in order to draw a skin fold 20 into the suction chamber, as is shown in FIG. 3. Once such a skin fold 20 has been drawn into the suction space of the suction chamber 12 a relative movement is possible between the skin of the skin fold 20 and the chamber wall 14. Such a relative movement occurs when the massaging apparatus 1 is moved over the skin 2 of a body area 3 in the operating direction 4. During such a movement of the massaging apparatus 1 over the skin 2 of a body area 3 the skin fold 20 formed moves further in the operating direction 4, which produces a massaging effect.

In the area of the bottom wall 11 the massaging apparatus 1 further comprises two rollers 21 and 22, which are each rotatable about a respective roller axis 23 or 24 which extends transversely to the operating direction 4 and which can be placed onto the skin 2 of a body area 3 with their respective circumferential surfaces 25 and 26. Of the two rollers 21 and 22 the forward roller 21, as viewed in the operating direction 4, is disposed inside the suction chamber 12 and the rearward roller 22, as viewed in the operating direction 4, is disposed outside the suction chamber 12, as is apparent in particular from FIG. 3.

In the massaging apparatus 1 the two rollers 21 and 22 can be driven by a motor 28, which drives the two rollers 21 and 22 via a drive transmission 28, of which only an intermediate gear wheel 29 is visible in FIG. 3. The two rollers 21 and 22 can be driven in the same direction of rotation, as indicated for the roller 22 by means of an arrow 30 in FIG. 3. The same direction of rotation 30 for the two rollers 21 and 22 is defined in such a manner that the speed vectors of the circumferential areas of the circumferential surfaces 25 and 26 of the two rollers 21 and 22, which face the skin 2 with the massaging apparatus 1 placed on the skin 2 of a body area 3, are oriented oppositely to the operating direction 4. Owing to this direction of rotation of the two rollers 21 and 22 the massaging apparatus 1 is driven in the operating direction 4 with the aid of the two rollers 21 and 22 by cooperation with the skin 2 of a body area 3.

In the massaging apparatus 1, in order to guarantee optimum driving of the massaging apparatus 1 by means of the two rollers 21 and 22, the circumferential surface 25 of the forward roller 21, as viewed in the operating direction 4, consists of a comparatively soft material having a hardness in a range between 40 Shore A and 95 Shore A, a value of approximately 85 Shore A having proved to be very favorable in practice. Furthermore, in the massaging apparatus 1 the circumferential surface 26 of the rearward roller 22, as viewed in the operating direction 4, consists of a comparatively hard material having an indentation hardness in a range between 50 N/mm2 and 180 N/mm2 determined with a test load of 358 N and a test time of 30 seconds in accordance with ISO 2039, a value of approximately 144 N/mm2 having proved to be very favorable in practice.

Moreover, in the massaging apparatus 1 the circumferential surface 25 of the forward roller 21, as viewed in the operating direction 4, is given a slightly concave shape and is provided with a multitude of studs 31, as is apparent in particular from FIG. 2. Furthermore, in the massaging apparatus 1 the circumferential surface 26 of the rearward roller 22, as viewed in the operating direction 4, is given a smooth shape.

The implementation of the circumferential surfaces 25 and 26 of the two rollers as described in the foregoing, not only results in the massaging apparatus 1 being driven satisfactorily in order to move it over the skin 2 of a body area 3 but, in addition, it also enhances the formation of a skin fold 20 in an advantageous manner.

Furthermore, for effectively assisting in the formation of a skin fold 20 in the massaging apparatus 1 the forward roller 21, as viewed in the operating direction 4, may be driven with a slightly higher speed than the rearward roller 22, as viewed in the operating direction, as a result of which the rearward roller 22 in relation to the forward roller 21 exerts a slight braking action on the skin 2 of a body area 3, which has a favorable effect on the formation of a skin fold 20.

As already stated hereinbefore, a relative movement occurs between the skin of the skin fold 20 and at least one chamber wall during a massaging session, in the present massaging apparatus particularly the chamber wall 14 but also the two chamber walls 15 and 16. In the massaging apparatus 1 it has therefore proved to be very advantageous if at least in an area of at least one chamber wall, in the present case in an area of the chamber wall 14 which extends transversely to the operating direction 4 and which is situated at the rear as seen in the operating direction 4, in which area a relative movement between the skin fold 20 and the chamber wall 14 is possible, at least one apparatus part which is movable relative to the chamber wall 14, in the present case at least one cylinder, is provided. In the massaging apparatus 1 two cylinders arranged in tandem are provided in the area of the chamber wall 14, which cylinders are rotatable about respective roller axes 34 and 35 which extend transversely to the operating direction 4, the two cylinder axes 34 and 35 extending parallel to the two roller axes 23 and 24 of the two rollers 21 and 22.

As is apparent from FIG. 3, the location of the at least one apparatus part which is movable with respect to the chamber wall 14, i.e. the location of the two cylinders 32 and 33, is selected in such a manner that, as the massaging apparatus 1 is moved over the skin 2 of a body area 3 and thus a skin fold is drawn into the suction chamber 12, the at least one apparatus part, i.e. the two cylinders 32 and 33, is movable with respect to the chamber wall 14 by the skin of the skin fold 20. In the present case the two cylinders 32 and 33 are rotationally driven by the skin of the skin fold 20 in the direction indicated by the arrow 30 during a massaging session. In order to achieve that this rotational drive of the two cylinders 32 and 33 with the aid of the skin of the skin fold is effected in an effective manner, the two cylinders 32 and 33 in the massaging apparatus 1 each project with their respective circumferential surfaces into the suction space bounded by the suction chamber 14 beyond the bounding surface 36 of the chamber wall 14 facing the suction space.

In order to accommodate the two cylinders 32 and 33 the massaging apparatus 1 has a recess 37 in the area of the chamber wall 14, which recess is open towards the suction space enclosed by the suction chamber 12 and for the remainder is bounded by recess walls 38, 39, 40 and 41 which are connected to the chamber wall 14. The two cylinders 32 and 33 are for the greater part disposed in this recess.

The provision of the two cylinders 32 and 33, which are rotationally drivable by the skin of the skin fold 20 formed during a massaging session, advantageously ensures that now a sliding friction occurs between a small area of the chamber wall 14 and the skin fold 20 then formed, while as a result of the provision of the two cylinders 32 and 33 in the remaining area only a rolling friction occurs between the two cylinders 32 and 33 and the skin fold 20 which is formed, the resulting friction between the skin of the skin fold 20 and the apparatus parts and apparatus areas which cooperate with the skin of the skin fold 20 being distinctly smaller as compared with a massaging apparatus having no such cylinders. As a result of this, the massaging apparatus 1 as shown in FIGS. 1 to 3 can be moved comparatively smoothly over the skin 2 of a body area 3 of a person.

What is claimed is:

1. A massaging apparatus, movable over the skin of a person in a given operating direction, said apparatus comprising;

a suction chamber enclosing a suction space, said chamber comprising a first and a second chamber wall, spaced from each other, and extending substantially transverse to the operating direction and a third and a fourth chamber wall, spaced from each other, extending substantially parallel to the operating direction, and connected to the first and second chamber wall, said suction chamber being open in an area for facing the skin, a pump, for generating a partial vacuum inside the suction chamber for forming a skin fold and drawing said skin fold into the suction chamber when the massaging apparatus is disposed on the skin of a person, said pump communicating with the suction chamber via an air-transfer duct, two rollers, each having a circumferential surface for contacting the skin of a person, each rotatable about a pair of roller axes extending transversely to the operating direction, a motor and drive transmission for driving the rollers in a same direction of rotation, speed vectors of circumferential areas of the circumferential surfaces which face said skin oriented opposite to the operating direction, one of the rollers, disposed in the front of said apparatus, as viewed in the operating direction, arranged inside the suction chamber, and the other of the rollers, disposed in the rear of the apparatus, as viewed in the operating direction, arranged outside of the suction chamber wherein;

the circumferential surface of the roller, disposed in the front of the apparatus, as viewed in the operating direction, consists of as material having a friction value higher than that of the material of the circumferential surface of the roller, disposed in the rear of the apparatus, when viewed in the operating direction.

2. A massaging apparatus (1) as claimed in claim 1, characterized in that the circumferential surface (25) of the roller (21) which is disposed at the front, as viewed in the operating direction (4), consists of a comparatively soft material having a hardness in a range between 40 Shore A and 95 Shore A, and the circumferential surface (26) of the roller (22) which is disposed at the rear, as viewed in the operating direction (4), consists of a comparatively hard material having an indentation hardness in a range between 50 $N/mm^2$ and 180 $N/mm^2$ determined with a test load of 358 N and a test time of 30 seconds in accordance with ISO 2039.

3. A massaging apparatus (1) as claimed in claim 1, characterized in that the circumferential surface (25) of the roller (21) which is disposed at the front, as viewed in the operating direction (4), has a multitude of studs (31), and the circumferential surface (26) of the roller (22) which is disposed at the rear, as viewed in the operating direction (4) has a smooth shape.

* * * * *